US008113394B2

(12) United States Patent
Ho

(10) Patent No.: US 8,113,394 B2
(45) Date of Patent: Feb. 14, 2012

(54) GARMENT HANGER INCLUDING FOLD-OVER PAPER SIZER

(75) Inventor: Leung Ho, Kowloon (HK)

(73) Assignee: The Build-Up Plastic & Metal Co., Ltd., Kowloon (HK)

( * ) Notice: Subject to any disclaimer, the term of this patent is extended or adjusted under 35 U.S.C. 154(b) by 151 days.

(21) Appl. No.: 12/474,725

(22) Filed: May 29, 2009

(65) Prior Publication Data

US 2009/0294494 A1 Dec. 3, 2009

Related U.S. Application Data

(60) Provisional application No. 61/057,132, filed on May 29, 2008.

(51) Int. Cl.
*A41D 27/22* (2006.01)

(52) U.S. Cl. ..... 223/85; 40/322

(58) Field of Classification Search ..... 223/85, 223/88, 92, 95; 40/322
See application file for complete search history.

(56) References Cited

U.S. PATENT DOCUMENTS

| | | | |
|---|---|---|---|
| 1,142,720 | A | 6/1915 | McAuley |
| 1,321,926 | A | 11/1919 | Landry |
| 1,348,952 | A | 8/1920 | Landry |
| 1,389,266 | A | 8/1921 | Newton |
| 1,710,296 | A | 4/1929 | Clark |
| 2,166,492 | A | 7/1939 | Harvey |
| 2,690,863 | A | 10/1954 | Adelman |
| 2,801,036 | A | 7/1957 | Klein |
| 3,024,953 | A | 3/1962 | O'Keefe |
| D192,845 | S | 5/1962 | Cohen |
| 3,535,808 | A | 10/1970 | Morrish |
| D229,810 | S | 1/1974 | Wahl |
| D235,639 | S | 7/1975 | Cohen |
| 3,898,754 | A | 8/1975 | Johansson |
| 3,949,914 | A | 4/1976 | Ostroll |
| 4,006,547 | A | 2/1977 | Samuels et al. |
| 4,017,990 | A | 4/1977 | Garrison |
| D244,197 | S | 5/1977 | Ostroll |
| 4,045,899 | A | 9/1977 | Richardson |
| 4,115,940 | A | 9/1978 | Phillips |
| 4,123,864 | A | 11/1978 | Batts et al. |
| 4,137,661 | A | 2/1979 | Johansson |
| 4,160,333 | A | 7/1979 | Indelicato |
| 4,198,773 | A | 4/1980 | Batts et al. |

(Continued)

FOREIGN PATENT DOCUMENTS

AU B1-42320/78 6/1979

(Continued)

OTHER PUBLICATIONS

U.S. Appl. No. 10/889,433, by Ho, et al., filed Jul. 12, 2004.

(Continued)

*Primary Examiner* — Nathan Durham
(74) *Attorney, Agent, or Firm* — Hoffmann & Baron, LLP

(57) ABSTRACT

A garment hanger having a fold over paper sizer. The hanger includes a sizer-receiving web defining opposing sizer-receiving slots. A paper sizer is folded from a flat unfolded state to a folded U-shaped state, and then installed about the web such that a first edge of the sizer is received within the first sizer-receiving slot and a second edge of the sizer is received within the second sizer-receiving slot.

6 Claims, 4 Drawing Sheets

U.S. PATENT DOCUMENTS

| | | | |
|---|---|---|---|
| 4,322,902 | A | 4/1982 | Lenthall |
| 4,450,639 | A | 5/1984 | Duester |
| 4,653,678 | A | 3/1987 | Blanchard et al. |
| 4,679,340 | A | 7/1987 | Johansson |
| 4,756,104 | A | 7/1988 | Bailey |
| 4,881,836 | A | 11/1989 | Blanchard |
| 4,886,195 | A | 12/1989 | Blanchard |
| 4,967,500 | A | 11/1990 | Bredeweg |
| 4,997,114 | A | 3/1991 | Petrou |
| 5,056,248 | A | 10/1991 | Blanchard |
| 5,096,101 | A | 3/1992 | Norman et al. |
| 5,135,141 | A | 8/1992 | Harmer et al. |
| 5,199,608 | A | 4/1993 | Zuckerman |
| 5,238,159 | A | 8/1993 | Zuckerman |
| 5,305,933 | A | 4/1994 | Zuckerman |
| 5,377,884 | A | 1/1995 | Zuckerman |
| 5,381,938 | A | 1/1995 | Vasudeva |
| 5,383,583 | A | 1/1995 | Zuckerman |
| 5,388,354 | A | 2/1995 | Marshall et al. |
| 5,407,109 | A | 4/1995 | Zuckerman |
| 5,441,182 | A | 8/1995 | Sullivan |
| 5,449,099 | A | 9/1995 | Blanchard |
| 5,469,995 | A | 11/1995 | Bredeweg et al. |
| 5,477,995 | A | 12/1995 | Dooley et al. |
| 5,485,943 | A | 1/1996 | Zuckerman |
| 5,503,310 | A | 4/1996 | Zuckerman et al. |
| 5,524,801 | A | 6/1996 | Dooley et al. |
| 5,573,151 | A | 11/1996 | Fildan |
| 5,586,697 | A | 12/1996 | Johansson |
| 5,590,822 | A | 1/1997 | Zuckerman |
| 5,597,100 | A | 1/1997 | Blitz |
| 5,603,437 | A | 2/1997 | Zuckerman |
| 5,611,469 | A | 3/1997 | Eiley et al. |
| 5,613,629 | A | 3/1997 | Zuckerman |
| 5,628,132 | A | 5/1997 | Marshall et al. |
| 5,641,100 | A | 6/1997 | Mitchell et al. |
| 5,642,840 | A | 7/1997 | Abdi |
| 5,683,018 | A | 11/1997 | Sullivan et al. |
| 5,687,887 | A | 11/1997 | Bond et al. |
| 5,775,553 | A | 7/1998 | Marshall et al. |
| 5,778,575 | A | 7/1998 | Deupree et al. |
| 5,785,216 | A | 7/1998 | Gouldson et al. |
| 5,794,363 | A | 8/1998 | Marshall et al. |
| 5,819,995 | A | 10/1998 | Zuckerman |
| 5,857,276 | A | 1/1999 | Marshall et al. |
| 5,884,422 | A | 3/1999 | Marshall et al. |
| D410,793 | S | 6/1999 | Gouldson |
| 5,913,462 | A | 6/1999 | Petrou |
| 5,944,237 | A | 8/1999 | Gouldson |
| D414,044 | S | 9/1999 | Choi et al. |
| 5,950,883 | A | 9/1999 | Bond et al. |
| 6,019,260 | A | 2/2000 | Gouldson |
| 6,029,868 | A | 2/2000 | Willinger et al. |
| 6,041,983 | A | 3/2000 | Sullivan et al. |
| 6,041,984 | A | 3/2000 | Gouldson |
| 6,145,713 | A | 11/2000 | Zuckerman |
| 6,189,746 | B1 | 2/2001 | Gouldson |
| D440,409 | S | 4/2001 | Blanchard |
| 6,209,241 | B1 | 4/2001 | Louw |
| 6,260,745 | B1 | 7/2001 | Gouldson et al. |
| 6,264,075 | B1 | 7/2001 | Gouldson et al. |
| 6,378,744 | B2 | 4/2002 | Olk et al. |
| 6,382,478 | B2 | 5/2002 | Gouldson et al. |
| 6,409,057 | B1 | 6/2002 | Kim |
| 6,422,437 | B2 | 7/2002 | Gouldson et al. |
| 6,499,633 | B1 | 12/2002 | Pogmore |
| 6,499,634 | B2 | 12/2002 | Olk et al. |
| 6,523,240 | B1 | 2/2003 | Gouldson |
| 6,564,980 | B2 | 5/2003 | Gouldson et al. |
| 6,609,640 | B1 | 8/2003 | Bokmiller |
| 6,622,897 | B2 | 9/2003 | Bokmiller et al. |
| 6,726,067 | B2 | 4/2004 | Louw |
| 7,015,815 | B1 | 3/2006 | Feibelman |
| 2001/0011663 | A1 | 8/2001 | Olk et al. |
| 2001/0016994 | A1 | 8/2001 | Gouldson et al. |
| 2001/0019070 | A1 | 9/2001 | Gouldson et al. |
| 2002/0184799 | A1 | 12/2002 | Chou |
| 2003/0019137 | A1 | 1/2003 | Giustini et al. |
| 2003/0173381 | A1 | 9/2003 | Louw |
| 2003/0178451 | A1 | 9/2003 | Giustini et al. |
| 2004/0211796 | A1 | 10/2004 | Misumi |
| 2006/0011673 | A1 | 1/2006 | Gouldson |
| 2006/0049222 | A1 | 3/2006 | Pluchino et al. |
| 2007/0175932 | A1 | 8/2007 | Wu |
| 2007/0228089 | A1 | 10/2007 | Mainetti |
| 2007/0257071 | A1* | 11/2007 | Gouldson ..... 223/85 |
| 2008/0035685 | A1 | 2/2008 | Matkovich et al. |
| 2008/0054029 | A1* | 3/2008 | Ho ..... 223/88 |

FOREIGN PATENT DOCUMENTS

| | | | |
|---|---|---|---|
| AU | B1-55 988/80 | | 6/1980 |
| AU | A-49049/85 | | 5/1986 |
| DE | 3306781 | A1 | 8/1984 |
| DE | 3401816 | A1 | 7/1985 |
| GB | 2064472 | A | 6/1981 |
| GB | 2140679 | A | 1/1984 |
| GB | 2386320 | A | 9/2003 |
| JP | Y-S48-23356 | | 7/1973 |
| JP | U-S52-009400 | | 1/1977 |
| JP | U-S52-043890 | | 3/1977 |
| JP | U-S57-095869 | | 6/1982 |
| JP | U-S57-189540 | | 12/1982 |
| JP | U-S61-11374 | | 1/1986 |
| JP | U-S61-147062 | | 9/1986 |
| JP | U-H03-019354 | | 2/1991 |
| JP | U-H05-037183 | | 5/1993 |
| JP | U-H06-052800 | | 7/1994 |
| JP | U-H07-025872 | | 5/1995 |
| JP | A-H07-241229 | | 9/1995 |
| JP | A-H08-140816 | | 6/1996 |
| JP | U-H08-001346 | | 9/1996 |
| JP | A-H10-052356 | | 2/1998 |
| JP | A-2000-287817 | | 10/2000 |
| JP | A-2001-062190 | | 3/2001 |
| JP | A-2001-112605 | | 4/2001 |
| WO | WO 96/23436 | | 8/1996 |
| WO | WO 01/50930 | A1 | 7/2001 |

OTHER PUBLICATIONS

U.S. Appl. No. 11/803,106, by Leung Ho, filed May 11, 2007.
U.S. Appl. No. 12/474,502 by Ho, et al., filed May 29, 2009.
Reference Hanger 1—Photographs of commercially-available garment hanger with size indicator; Jul. 1, 2003.
Reference Hanger 2—Photographs of commercially-available garment hanger with size indicator; Jul. 1, 2003.
Reference Hanger 3—Photographs of commercially-available garment hanger with size indicator; Jul. 1, 2003.
Reference Hanger 4—Photographs of commercially-available garment hanger with size indicator; Jul. 1, 2003.
Reference Hanger 5—Photographs of commercially-available garment hanger with size indicator; Jul. 1, 2003.
Reference Hanger 6—Photographs of commercially-available garment hanger with size indicator; Jul. 1, 2003.
Reference Hanger 7—Photographs of commercially-available garment hanger with size indicator; Jul. 1, 2003.
Reference Hanger 8—Photographs of commercially-available garment hanger with size indicator; Jul. 1, 2003.
Reference Hanger 9—Photographs of commercially-available garment hanger with size indicator; Jul. 1, 2003.
Reference Hanger 10—Photographs of commercially-available garment hanger with size indicator; Jul. 1, 2003.
Reference Hanger 11—Photographs of commercially-available garment hanger with size indicator; Jul. 1, 2003.
Reference Hanger 12—Photograph of commercially-available garment hanger with size indicator; Jul. 1, 2003.

* cited by examiner

GARMENT HANGER INCLUDING FOLD-OVER PAPER SIZER

This application claims the benefit of U.S. Provisional Application Ser. No. 61/057,132 filed May 29, 2008, the disclosure of which is hereby incorporated by reference in its entirety.

BACKGROUND OF THE INVENTION

The present invention relates to garment hangers and, more particularly, to garment hangers having sizers coupled thereto. Garment hangers are often provided with size indicators, also known as sizers, for providing indicia relating to the size or type of garment hung on the hanger, or other information. Such indicators are often in the form of small U-shaped tabs that are clipped on the hanger body. A common location for securing a size indicator to a hanger is a web portion of the hanger formed between the bottom end of the hanger hook and the top of the hanger body. Typical prior art arrangements are disclosed in U.S. Pat. Nos. 4,115,940, 5,096,101, 5,199,608, 5,238,159, 5,305,933, 5,383,583, 5,407,109, 5,441,182 and 5,449,099.

As will be recognized by those skilled in the art, the mentioned U-shaped size indicators are typically formed of plastic, and are designed to be secured to a hanger in a substantially non-removable manner, thereby reducing the likelihood that such indicators may be inadvertently removed from the hanger. The desire to couple the size indicator to the hanger in a non-removable manner typically increases the cost and complexity of such prior art indicators. Moreover, these prior art indicators are often times clipped to the hanger in a manner which allows the indicator to "wobble", which can detract from the overall aesthetic appeal of the hanger. It will be further appreciated that the very same design which increases the difficulty of removing the indicator from the hanger also increases the installation force required to install the indicator on the hanger body thereby rendering assembly more difficult and costly. Finally, it will be appreciated that any reduction in the usage of plastic is viewed as having a positive impact on the environment.

There is therefore a need in the art for a hanger/sizer combination which provides a less complex and costly design, which allows for ready assembly of the components, which reduces the environmental impact through decreased usage of plastic, which is more child-friendly, and which provides increased flexibility for printing of indicia/graphics on the sizer.

SUMMARY OF THE INVENTION

The present invention, which addresses the needs of the prior art, relates to a garment hanger having a fold-over side sizer. In particular, the garment hanger includes a body. The garment hanger further includes a hook having a base portion joined to the body and an outer surface forming an acute angle with the body. The acute angle defines a notch at the junction of the body and the base portion of the hook. The garment hanger further includes a sizer-receiving web positioned within the notch. At least a portion of the web extends between and connects the hanger body and the base portion of the hook. The garment hanger further includes a first rib positioned along the junction and located on a first side of the web. A first sizer-receiving slot is defined between the first rib and the web. The garment hanger further includes a second rib positioned along the junction and located on a second side of the web. A second sizer-receiving slot is defined between the second rib and the web. Finally, the garment hanger includes a paper sizer foldable between a flat unfolded state and a folded U-shaped state. The sizer is shaped and sized to substantially match the configuration of the notch when installed about the web in the folded state. The sizer in the folded state is installed about the web such that a first edge of the sizer is received within the first sizer-receiving slot and a second edge of the sizer is received within the second sizer-receiving slot.

The present invention further relates to a garment hanger having a fold-over top sizer. In particular, the garment hanger includes a body and a hook having a base portion joined to the body. The garment hanger further includes a sizer-receiving web secured to an upper portion of the hook. The garment hanger further includes a first rib positioned on a first side of the web and defining a first sizer-receiving slot. The garment hanger further includes a second rib positioned on a second side of the web and defining a second sizer-receiving slot. Finally, the garment hanger includes a paper sizer foldable between a flat unfolded state and a foldable U-shaped state. The sizer is shaped and sized to substantially match the configuration of the web when installed thereabout. The sizer in the folded state is installed about the web such that a first edge of the sizer is received within the first sizer-receiving slot and a second edge of the sizer is received within the second sizer-receiving slot.

As a result, the present invention provides a hanger/sizer combination which provides a less complex and costly design, which allows for ready assembly of the components, which reduces the environmental impact through decreased usage of plastic, which is more child-friendly, and which provides increased flexibility for printing of indicia/graphics on the sizer.

DETAILED DESCRIPTION OF THE INVENTION

Figure 1:
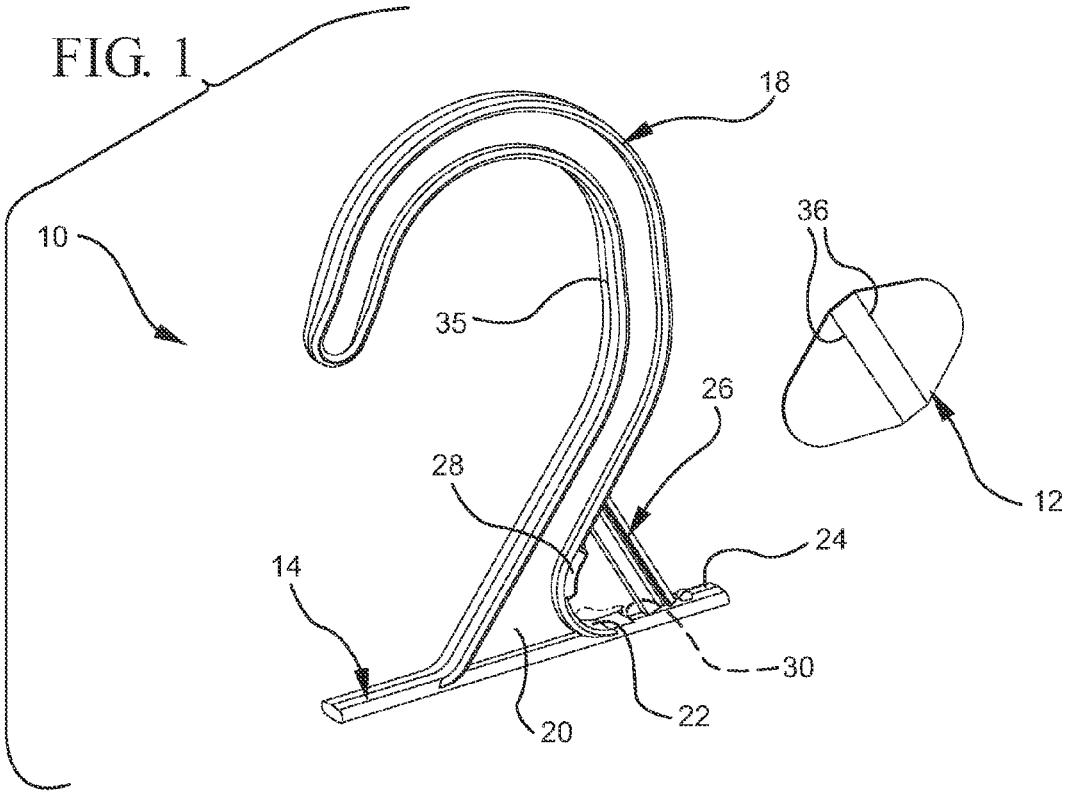
FIG. 1 is an exploded front perspective view of the hanger and sizer of the present invention showing the sizer in an unfolded state.

A garment hanger 10 is provided with a side sizer 12 in a manner that allows a person to easily view the information, such as garment size, provided on the sizer. As shown in FIGS. 1-4, garment hanger 10 includes a body 14. It is contemplated herein that body 14 can be formed with a pair of downwardly-depending arms as shown in U.S. Pat. No. 5,096,101 or, alternatively, can include a horizontally-extending bar as shown in U.S. Pat. Nos. 5,199,608 and 5,383,583.

A hook 18 is joined to body 14, preferably at the central portion of the hanger. The hook includes a base portion 20 that includes an outer surface extending at an acute angle with respect to an outer surface of body 14. A notch 22 is accordingly formed between base portion 20 of hook 18 and a top surface 24 of body 14.

A sizer-receiving web 26 is positioned within the notch. The web is integral with both body 14 and base portion 20 of hook 18. A first rib 28 is formed on one side of web 26, while a second rib 30 is formed on the other side of web 26. A sizer-receiving slot is formed between each rib and the adjacent portion of web 26. In addition, hook 18 may include a tab 32, while top surface 24 may include a tab 34.

Thus, garment hanger 10 (except for sizer 12) is preferably an integrally molded plastic structure. It includes a substantially continuous peripheral wall 35 that provides stiffness. The wall may include gaps (not shown) in certain portions of the hanger that may be used to support garments or may be provided with clips or the like (not shown).

Sizer 12 is preferably formed as a flat pattern, i.e., in an unfolded state. In one preferred embodiment, sizer 12 is formed of paper, thus reducing the overall usage of resin in the hanger/sizer combination. As will be appreciated by those skilled in the art, this reduction in usage of resin is believed to be positive for the environment. Moreover, the usage of paper for the sizer provides a more child-friendly product, as well as an improved base for printing and/or application of graphics thereon.

Figure 2:
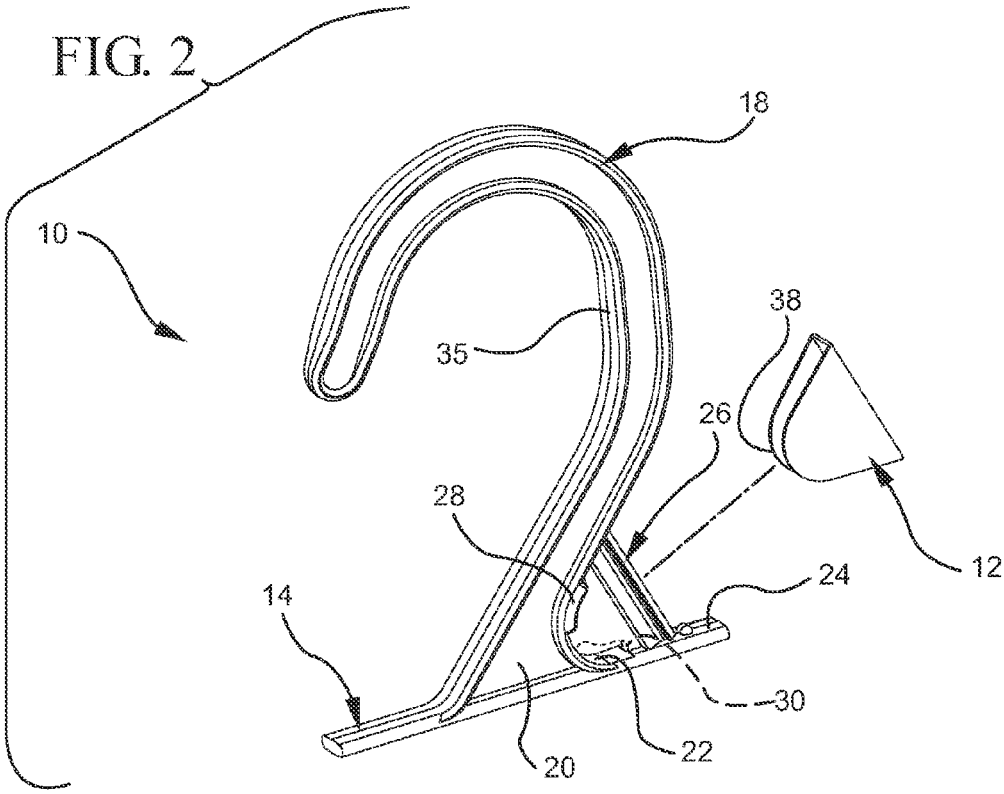
FIG. 2 is a view similar to FIG. 1 showing the sizer in a folded state.
Figure 3:
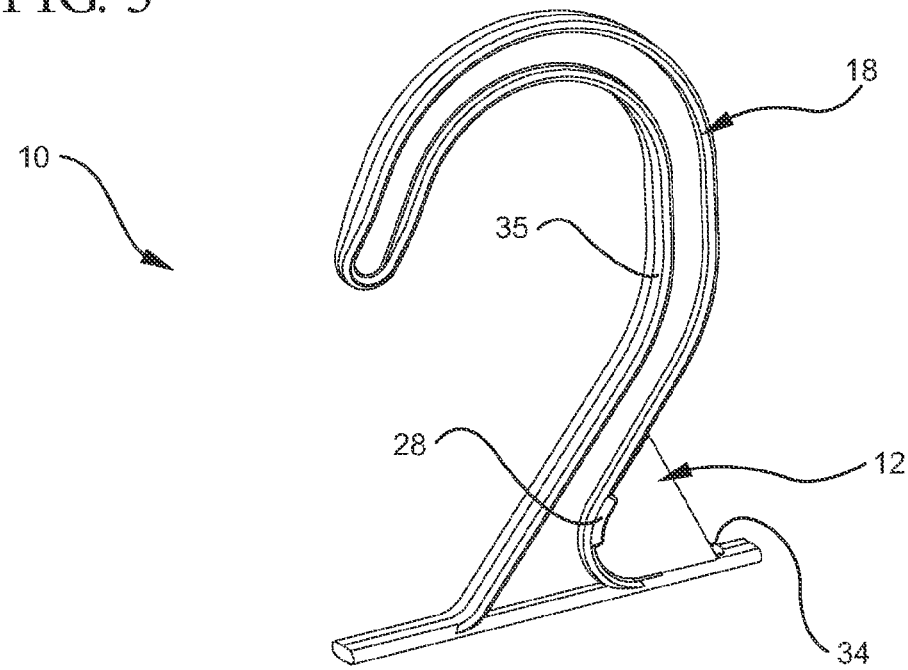
FIG. 3 is a view similar to FIG. 1 showing the hanger/sizer assembly.
Figure 4:
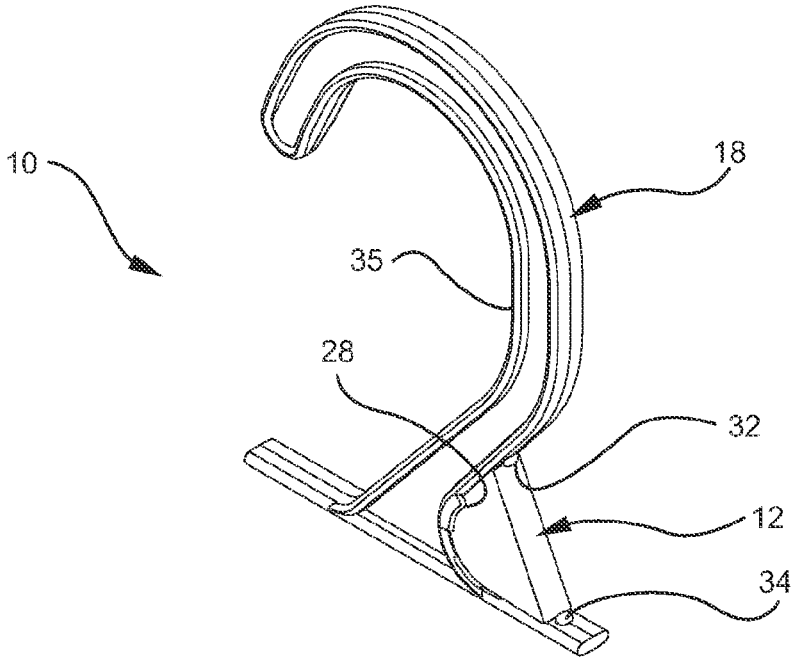
FIG. 4 is another view of the hanger/sizer assembly.
Figure 5:
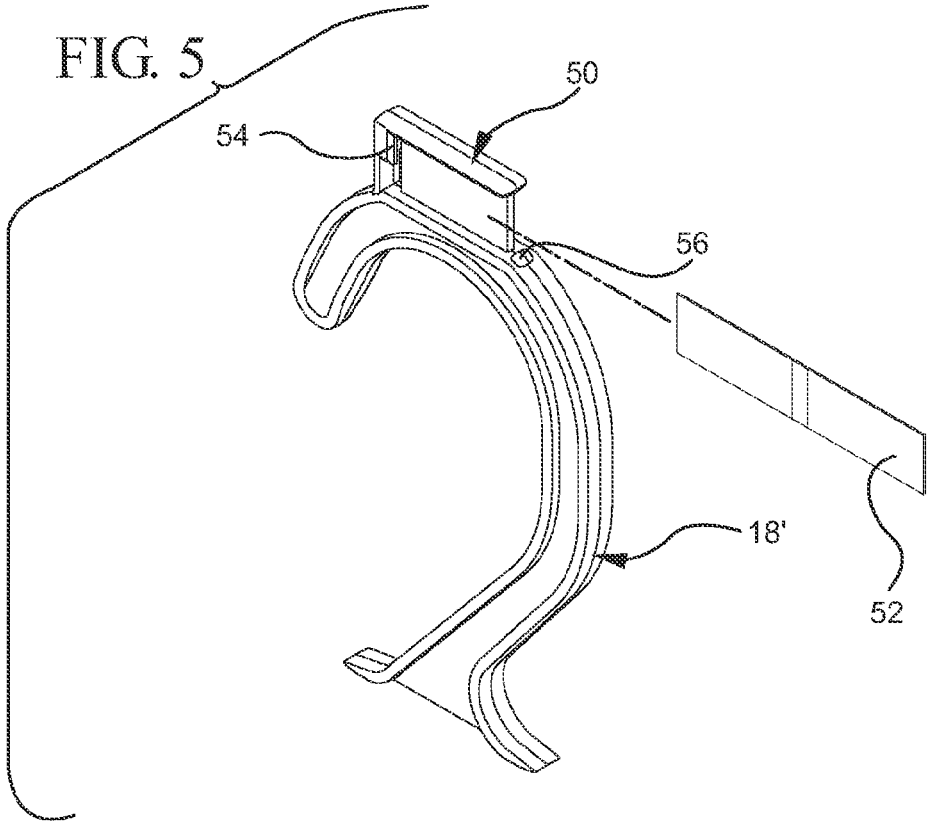
FIG. 5 is an exploded front perspective view of alternative embodiment showing the sizer in an unfolded state.
Figure 6:
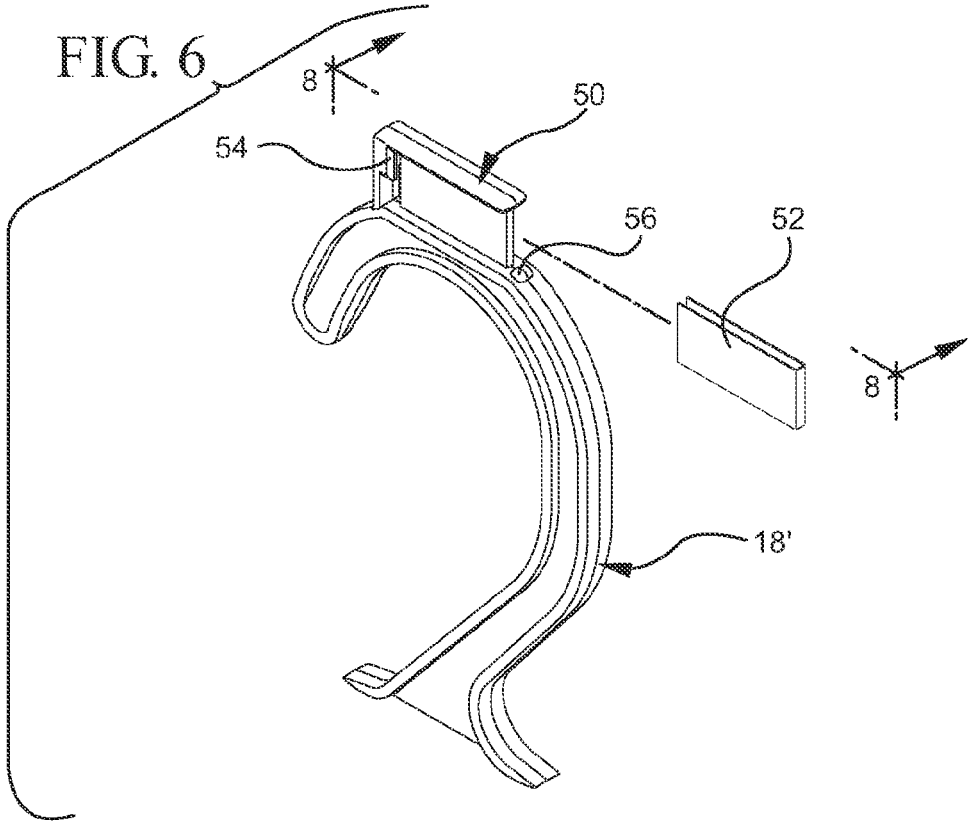
FIG. 6. is a view similar to FIG. 5 showing the sizer in a folded state.
Figure 7:
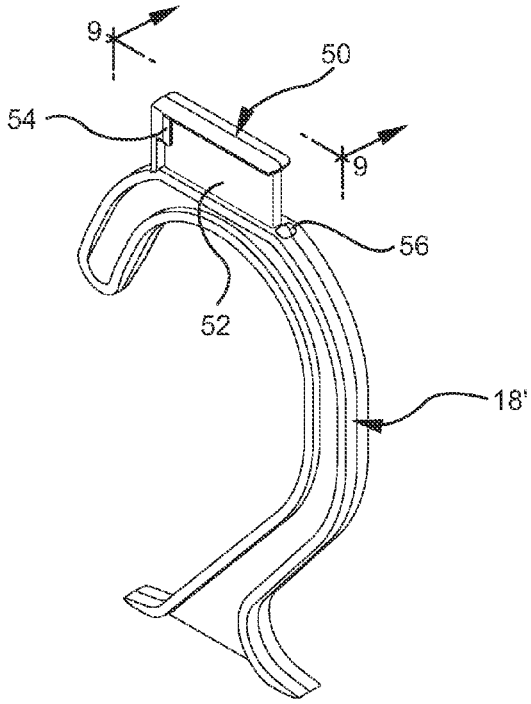
FIG. 7 is a view similar to FIG. 5 showing the hanger/sizer assembly.
Figure 8:
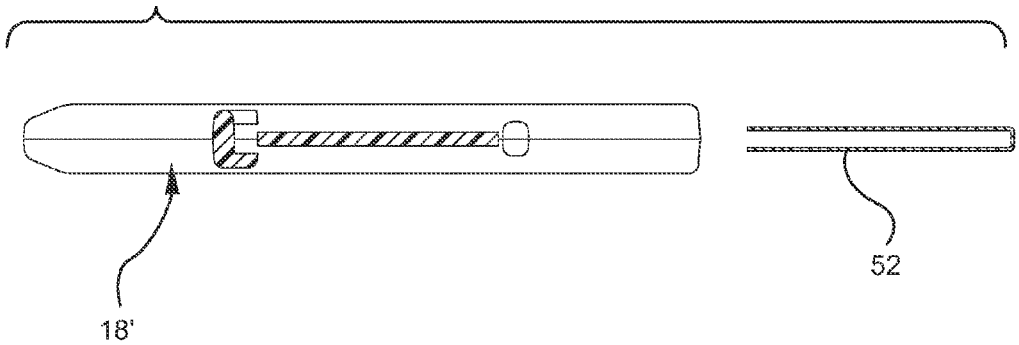
FIG. 8 is a cross-sectional view of FIG. 6.
Figure 9:
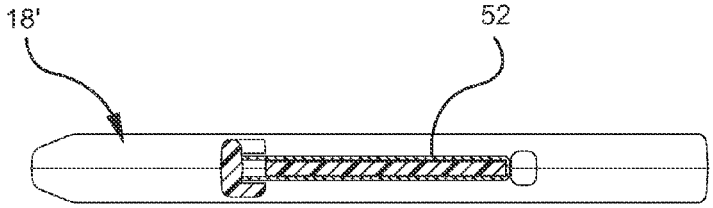
FIG. 9 is a cross-sectional view of a FIG. 7.

As best seen in FIGS. 3-4, sizer 12 is shaped and sized to substantially match the configuration of notch 22. To assemble the hanger/sizer combination, sizer 12 is folded about fold lines 36 to form a U-shaped clip (as best seen in FIG. 2). Sizer 12 is then positioned over web 26 such that a first leg of the sizer is located on a first side of the web, while the other leg of the sizer is located on the other side of the web. The sizer is preferably inserted over web 26 until apex 38 contacts notch 22, and until one edge of sizer 12 is inserted under rib 28 and another edge of sizer is inserted under rib 30. Once installed, tabs 32, 34 maintain the sizer in the installed position by resisting subsequent movement of the sizer. In one embodiment, an adhesive is installed on one or both of the web or sizer to further secure the sizer to the web.

Although the embodiment shown in FIGS. 1-4 is directed to what is commonly known referred to as a side sizer, it is contemplated herein that the slide-in sizer of the present invention can also be used in a top sizer arrangement. More particularly, as shown in FIG. 5-9, a sizer-receiving web 50 can be secured to an upper portion of hook 18' and can be sized and shaped to receive an alternative sizer, e.g., top sizer 52. In this regard, sizer-receiving web 50 preferably includes a first rib 54 formed on one side of the web, and a second web (not shown) formed on the other side of the web. A sizer-receiving slot is formed between each rib and the adjacent portion of the web. In addition, a tab 56 is preferably formed on a portion of hook 18' to resist movement of the sizer once such sizer has been installed over the web. Of course, it is contemplated herein that the size, shape and/or configuration of sizer-receiving web 50 can be varied. For example, sizer-receiving web could be provided with an oval configuration, or could be arranged such that the sizer is installed from an upper position, rather than from a side position.

Thus, while there have been described what are presently believed to be the preferred embodiments of the present invention, those skilled in the art will appreciate other and further changes and modifications thereto, and it is intended to include such other changes as come with the scope of the invention.

The invention claimed is:

1. A garment hanger, comprising:

a body;

a hook having a base portion joined to said body and an outer surface forming an acute angle with said body, said acute angle defining a notch at the junction of said body and said base portion of said hook;

a sizer-receiving web positioned within said notch, at least a portion of said web extending between and connecting said hanger body and said base portion of said hook;

a first rib positioned along said junction and located on a first side of said web, wherein a first sizer-receiving slot is defined between said first rib and said web;

a second rib positioned along said junction and located on a second side of said web wherein a second sizer-receiving slot is defined between said second rib and said web;

a paper sizer foldable between a flat unfolded state and a folded U-shaped state, said folded state defining opposing first and second legs and an end wall interconnecting said first and second legs, said sizer being shaped and sized to substantially match the configuration of said notch when installed about said web in said folded state, and wherein said sizer in said folded state is installed about said web such that said first leg of said sizer is received within said first sizer-receiving slot and said second leg of said sizer is received within said second sizer-receiving slot; and a first tab positioned on one of said hook and said body, said first tab being positioned outside of said notch and being located to engage said end wall of said sizer when said sizer is installed about said web thereby facilitating retention of said sizer within said notch.

2. The hanger according to claim 1, further comprising a second tab, wherein said first tab is located on said outer surface of said hook and said second tab is located on said outer surface of said body, and wherein each of said tabs engage said end wall of said sizer to facilitate retention of said sizer within said notch.

3. The hanger according to claim 1, wherein said sizer is provided with fold lines to facilitate folding of said sizer from said flat unfolded state to said folded U-shaped state.

4. A garment hanger, comprising:

a body;

a hook having a base portion joined to said body;

a sizer-receiving web secured to an upper portion of said hook, said web defining an insertion direction;

a first rib positioned on a first side of said web and defining a first sizer-receiving slot;

a second rib positioned on a second side of said web and defining a second sizer-receiving slot;

a paper sizer foldable between a flat unfolded state and a foldable U-shaped state, said folded state defining opposing first and second legs and an end wall interconnecting said first and second legs, each of said legs defining a leading edge distal from said end wall, said sizer being shaped and sized to substantially match the configuration of said web when installed thereabout, and wherein said sizer in said folded state is installed about said web in said insertion direction such that said leading edge of said first leg is received within said first sizer-receiving slot and said leading edge of said second leg is received within said second sizer-receiving slot; and at least one tab located along said insertion direction and positioned to engage said end wall of said sizer to resist movement of said sizer in a direction opposite to said insertion direction when said sizer is installed about said web thereby facilitating retention of said sizer about said web.

5. The hanger according to claim 4, wherein said sizer-receiving web includes an upper cap to facilitate retention of said sizer about said web.

6. A method of installing a sizer on a garment hanger, comprising providing a garment hanger, said garment hanger including:

a body;

a hook having a base portion joined to said body and an outer surface forming an outer angle with said body, said acute angle defining a notch at the junction of said body and said base portion of said hook;

a sizer-receiving web positioned within said notch, at least a portion of said web extending between and connecting said hanger body and said base portion of said hook;

a first rib positioned along said junction and located on a first side of said web, wherein a first sizer-receiving slot is defined between said first rib and said web;

a second rib positioned along said junction and located on a second side of said web wherein a second sizer-receiving slot is defined between said second rib and said web;

providing a paper sizer having two fold lines and foldable between a flat unfolded state and a folded U-shaped state;

folding said paper sizer from said flat unfolded state to said folded U-shaped state, said folded state defining opposing first and second legs and an end wall interconnecting said first and second legs;

installing said U-shaped sizer about said web until said first leg of said sizer is received within said first sizer-receiving slot and said second leg of said sizer is received within said second sizer-receiving slot;

wherein said hanger further includes a tab located on one of the outer surface of said hook and the outer surface of said body, said tab being positioned outside of said notch and being located to engage said end wall of said sizer when said sizer is installed about said web; and installing said sizer about said web until said end wall of said sizer passes said tab whereby said tab facilitate retention of said sizer in said notch.

* * * * *